US010495319B2

(12) United States Patent
Lee et al.

(10) Patent No.: US 10,495,319 B2
(45) Date of Patent: Dec. 3, 2019

(54) OVEN

(71) Applicant: SAMSUNG ELECTRONICS CO., LTD., Suwon-si, Gyeonggi-do (KR)

(72) Inventors: Dong Ho Lee, Suwon-si (KR); Seong Deog Jang, Suwon-si (KR); Cheol Eun Choi, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 135 days.

(21) Appl. No.: 15/327,530

(22) PCT Filed: Apr. 2, 2015

(86) PCT No.: PCT/KR2015/003336
§ 371 (c)(1),
(2) Date: Jan. 19, 2017

(87) PCT Pub. No.: WO2016/013752
PCT Pub. Date: Jan. 28, 2016

(65) Prior Publication Data

US 2017/0146247 A1 May 25, 2017

(30) Foreign Application Priority Data

Jul. 22, 2014 (KR) ..... 10-2014-0092556

(51) Int. Cl.
*F24C 15/18* (2006.01)
*F24C 15/32* (2006.01)
(Continued)

(52) U.S. Cl.
CPC ..... *F24C 15/18* (2013.01); *F24C 15/006* (2013.01); *F24C 15/2007* (2013.01); *F24C 15/322* (2013.01)

(58) Field of Classification Search
CPC ..... F24C 15/006
(Continued)

(56) References Cited

U.S. PATENT DOCUMENTS 7,129,447 B1 * 10/2006 Kim ..... F24C 15/166 219/394
8,101,894 B2 1/2012 Lee et al.
(Continued)

FOREIGN PATENT DOCUMENTS

CN 1731025 2/2006
CN 102188169 9/2011
(Continued)

OTHER PUBLICATIONS

Extended European Search Report dated Jul. 12, 2018 in European Patent Application No. 15825313.8.
(Continued)

*Primary Examiner* — Avinash A Savani
(74) *Attorney, Agent, or Firm* — Staas & Halsey LLP

(57) ABSTRACT

Disclosed is an over having an improved air moving structure. According to one aspect of the present invention, there is provided an oven including: a casing to form an external appearance of the oven; a cooking compartment positioned at an inside the casing, and having a first cooking compartment positioned at an upper side and a second cooking compartment positioned at a lower side; a door to open/close the cooking compartment; a divider positioned in between the first cooking compartment and the second cooking compartment; a first circulating fan and a second circulating fan coupled to rear surfaces of the each of the first cooking compartment and the second cooking compartment; an inlet unit configured to inlet outside air to at least one of the first cooking compartment and the second cooking compartment.

23 Claims, 9 Drawing Sheets

(51) Int. Cl.
*F24C 15/00* (2006.01)
*F24C 15/20* (2006.01)

(58) Field of Classification Search
USPC ..... 126/337 R, 21 A
See application file for complete search history.

(56) References Cited

U.S. PATENT DOCUMENTS

| | | | | |
|---|---|---|---|---|
| 2002/0148362 | A1* | 10/2002 | Cole | F24C 15/322 99/448 |
| 2007/0125760 | A1* | 6/2007 | Kim | F24C 15/006 219/391 |
| 2009/0110592 | A1 | 4/2009 | Lee et al. | |
| 2009/0183723 | A1 | 7/2009 | Hasslberger et al. | |
| 2013/0333685 | A1 | 12/2013 | Jeong et al. | |
| 2014/0174426 | A1 | 6/2014 | Moon et al. | |

FOREIGN PATENT DOCUMENTS

| | | |
|---|---|---|
| EP | 0 959 305 A2 | 11/1999 |
| EP | 1624255 | 2/2006 |
| EP | 2363648 | 9/2011 |

OTHER PUBLICATIONS

Chinese Office Action dated Sep. 7, 2018 in Chinese Patent Application No. 201580038365.6.
Australian Office Action dated Dec. 20, 2017 in Australian Patent Application No. 2015293017.
International Search Report dated Jul. 15, 2015 in corresponding International Application No. PCT/KR2015/003336.
Canadian Office Action dated Feb. 20, 2018 in Canadian Patent Application No. 2,953,928.
European Office Communication dated Mar. 1, 2017 in European Patent Application No. 15825313.8.
Partial European Search Report dated Mar. 19, 2018 in European Patent Application No. 15825313.8.
Australian Notice of Acceptance dated Apr. 30, 2018 in Australian Patent Application No. 2015293017.
Canadian Notice of Allowance dated Oct. 22, 2018 in Canadian Patent Application No. 2,953,928.
European Communication dated Jun. 13, 2019 in European Patent Application No. 15825313.8.
Chinese Office Action dated May 28, 2019 in Chinese Patent Application No. 201580038365.6.

* cited by examiner

[Fig. 1]
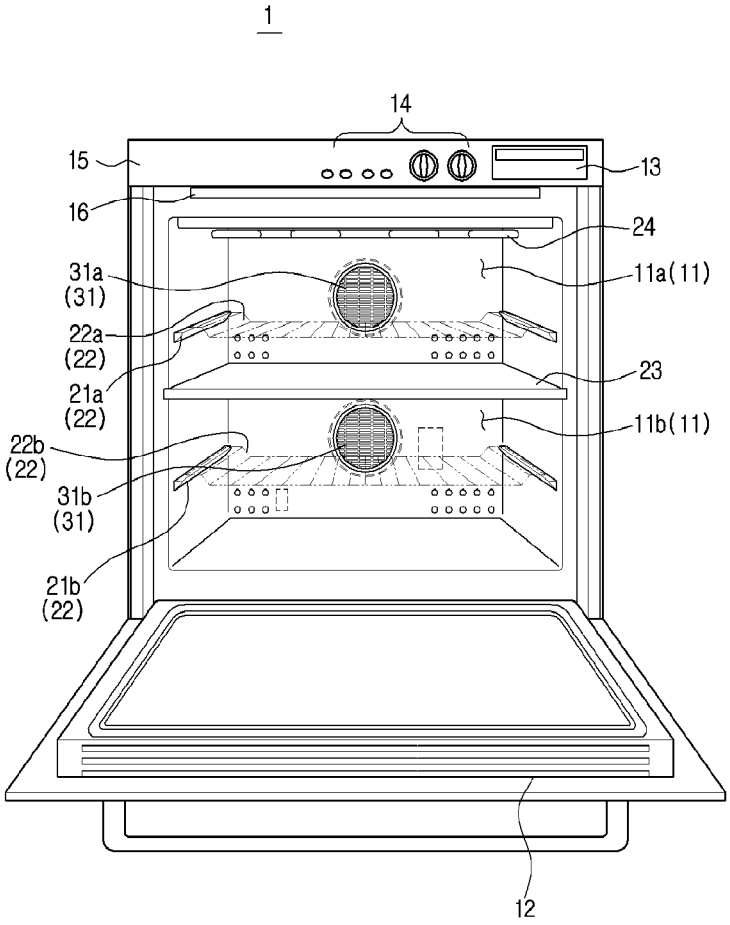

[Fig. 2]
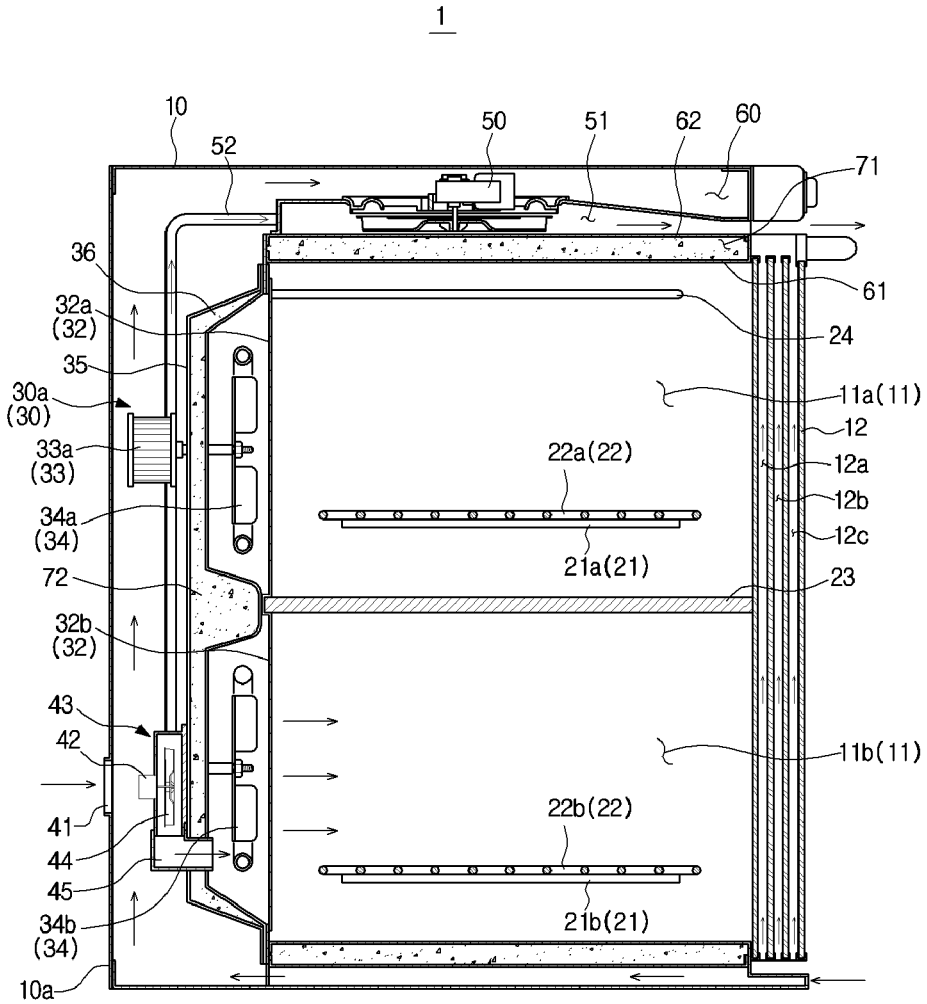

[Fig. 3]
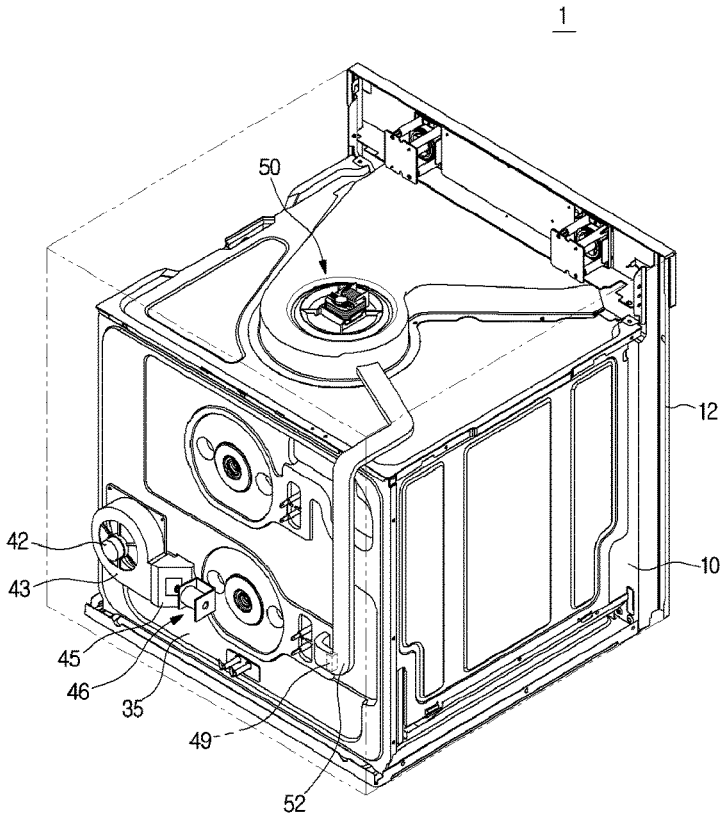
[Fig. 4]
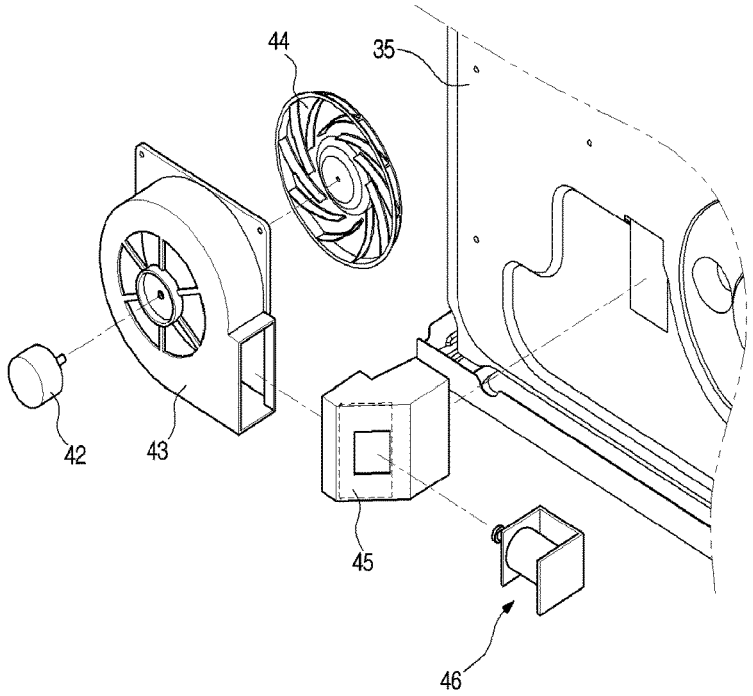

[Fig. 5]
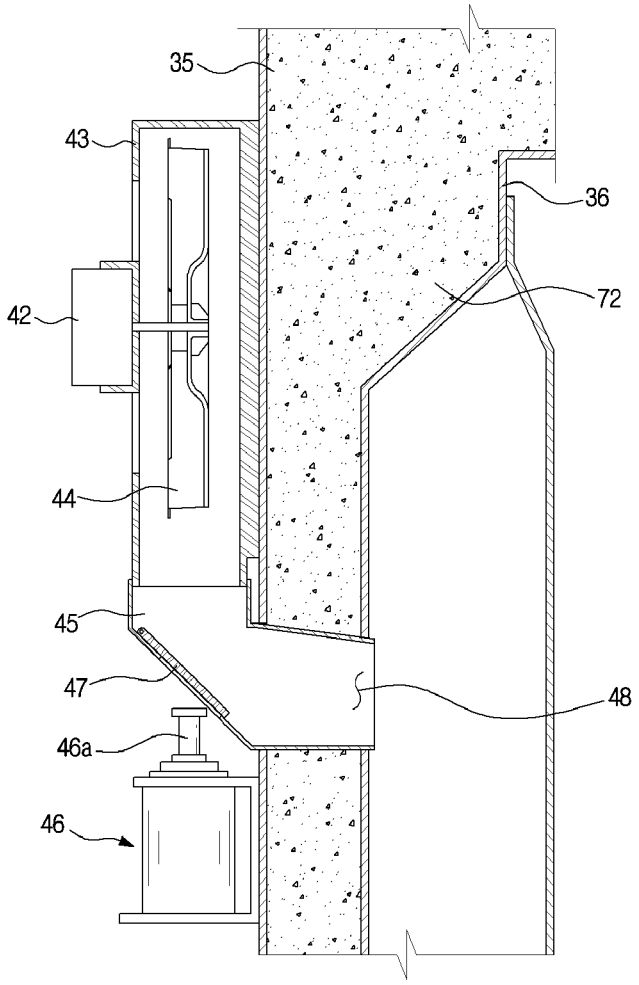

[Fig. 6]
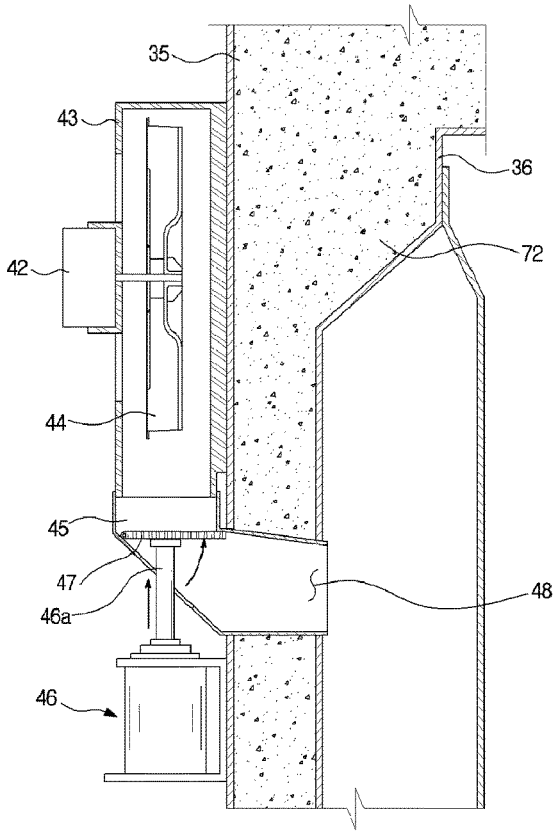
[Fig. 7]
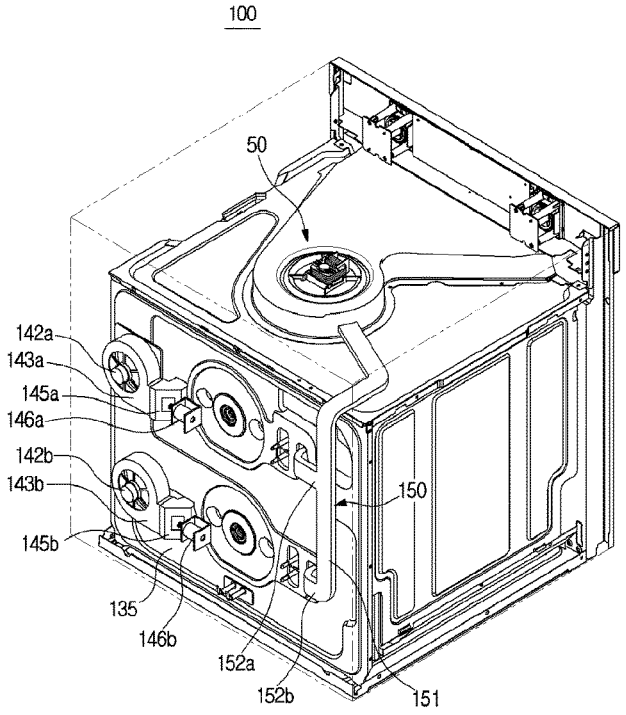

[Fig. 8]
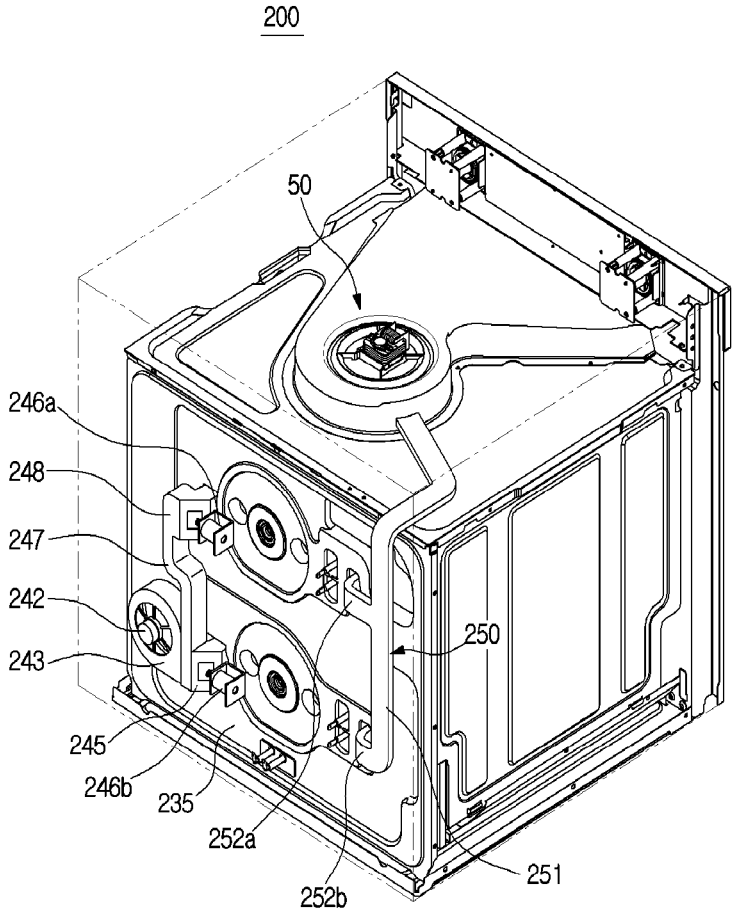

[Fig. 9]
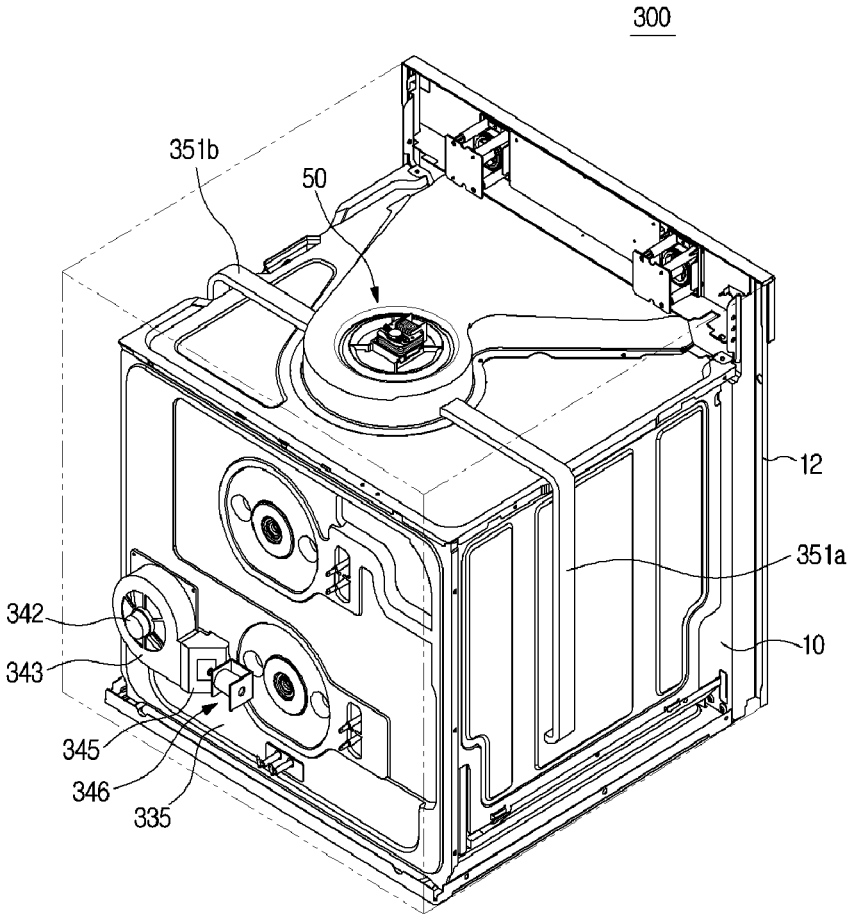

[Fig. 10]
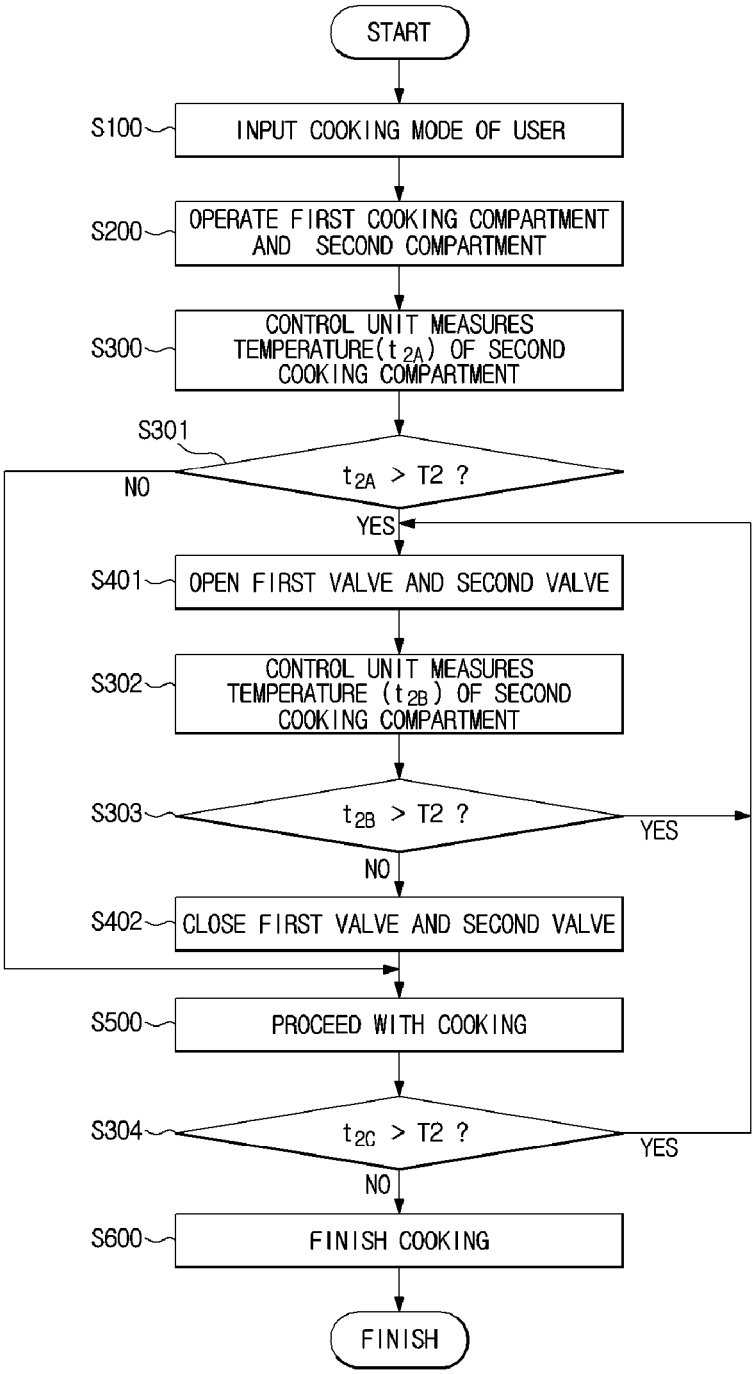

[Fig. 11]
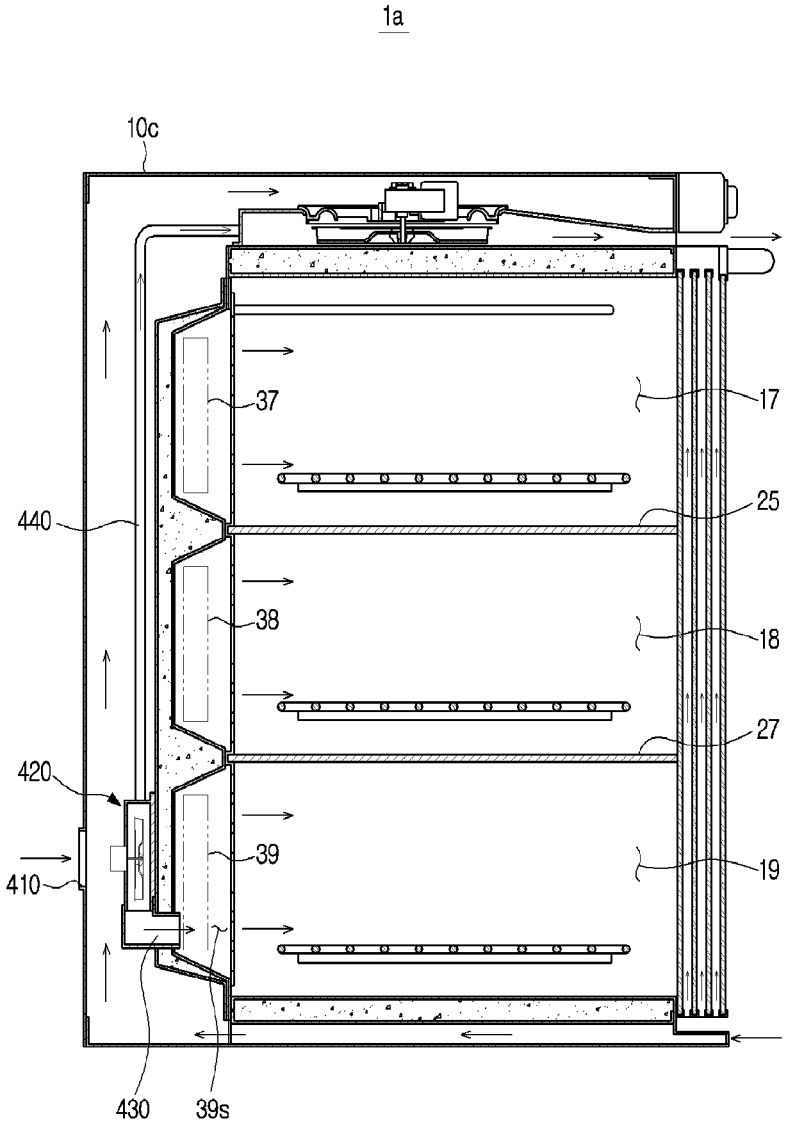

OVEN

CROSS-REFERENCE TO RELATED APPLICATION

This application is a U.S. national stage application, which claims the benefit under 35 USC § 371 of PCT International Patent Application No. PCT/KR2015/003336, filed Apr. 2, 2015 which claims foreign priority benefit under 35 USC § 119 of Korean Patent Application No. 10-2014-0092556, filed on Jul. 22, 2014, the entire contents of which are incorporated herein by reference.

TECHNICAL FIELD

Disclosed is an oven, and more particularly, an oven having an improved fluid moving structure to adjust the temperature difference of each cooking compartment when the cooking compartment is provided in a plurality of units.

BACKGROUND ART

An oven is an apparatus configured to cook by sealing and heating food material, and in general, the oven may be divided into an electric type, a gas type, and an electronic type. The electric oven uses an electric heater as a heat source, and the gas oven and the electronic oven respectively use the heat by gas and frictional heat of water molecules by high frequencies as heat sources.

Recently, a twin oven having a first cooking compartment positioned at an upper portion and a second cooking compartment positioned at a lower portion is used, and may conduct different cooking at each of the cooking compartments. A divider is positioned in between the first cooking compartment and the second compartment to divide the cooking compartments.

However, a complete sealing of the first cooking compartment and the second compartment is difficult only by the divider, and a heat transfer is taken place between the first cooking compartment and the second compartment. According to the above, the first cooking compartment and the second compartment only have the cooking processes requiring similar temperatures, so it is limited to simultaneously conduct different cooking processes at the first cooking compartment and the second compartment.

Disclosure

Technical Problem

The present invention provides an oven capable of introducing outside air to maintain a temperature difference between a first cooking compartment and a second compartment.

Technical Solution

According to an aspect of the present invention, there is provided an oven including a casing, a cooking compartment, a door, a divider, a first circulating fan and a second circulating fan, and an inlet unit. The casing may be configured to form an external appearance of the oven. The cooking compartment may be positioned at an inside the casing, and include a first cooking compartment positioned at an upper side and a second cooking compartment positioned at a lower side. The door may be configured to open/close the cooking compartment. The divider may be positioned in between the first cooking compartment and the second cooking compartment. The first circulating fan and the second circulating fan may be coupled to rear surfaces of the first cooking compartment and the second cooking compartment, respectively. The inlet unit may be configured to introduce outside air to at least one of the first cooking compartment and the second cooking compartment.

The inlet unit may include an inlet hole, and an inlet motor configured to introduce outside air while coupled to the inlet hole.

A guide bracket to guide the air that is taken in by the inlet motor to at least one of the first cooking compartment and the second cooking compartment may be positioned at one side of the inlet motor.

The oven may further include a first valve to open/close a flow path at an inside the guide bracket as to prevent the air at an inside the cooking compartment from released to an outside.

The guide bracket may be coupled to a communication hole provided to communicate with at least one of the first cooking compartment and the second cooking compartment.

The oven may further include an outlet pipe to communicate the cooking compartment with an outside so as to discharge a predetermined amount of air inside the cooking compartment corresponding to an amount of air introduced from the outside.

The oven may further include a cooling fan installed at an outer side of the cooking compartment as to lead a cooling of the door by intaking outside air.

The outlet pipe may be provided to communicate with the cooling fan.

The outlet pipe may be coupled to an outlet hole provided at one surface of the cooking compartment.

The oven may further include a second valve provided to open/close the outlet hole as to prevent a backward flow of air to the cooking compartment from the cooling fan.

The inlet hole may be provided at a position that is equal to or lower than a position of a half the height of the casing.

The inlet motor may be provided in a plurality of units thereof, and each of the plurality of inlet motors is coupled to a rear surface of each cooking compartment.

The outlet pipe may include a main outlet pipe, and a first branch outlet pipe and a second branch outlet pipe that are branched from the main outlet pipe and coupled to the first cooking compartment and the second cooking compartment, respectively.

According to an aspect of the present invention, there is provided an oven including a casing, a plurality of cooking compartments, a door, a divider, an inlet unit and an outlet unit. The casing may be configured to form an external appearance of the oven. The plurality of cooking compartments may be positioned at an inside the casing, and capable of cooking at each different temperatures. The door may be configured to open/close the plurality of cooking compartments. The divider may be configured to prevent heat from delivered in between the plurality of cooking compartments. The inlet unit may be provided to communicate with at least one of the plurality of cooking compartments to lower the temperature at an inside the plurality of cooking compartments by allowing outside air to be introduced. The outlet unit may be configured such that air having high temperature at an inside the plurality of cooking compartments is discharged to an outside.

The inlet unit may include an inlet hole, and an inlet motor configured to communicate with the inlet hole as to introduce outside air by intaking the outside air through the inlet hole.

The oven may further include a communication hole to communicate with the plurality of cooking compartments such that the air that is introduced through the inlet hole and the inlet motor is moved to an inside the plurality of cooking compartments.

The oven may further include a guide bracket positioned in between the communication hole and the inlet motor, wherein a first valve to open/close the communication hole to prevent the air at an inside the plurality of cooking compartments from being released to an outside may be positioned at an inside the guide bracket.

The outlet unit may include an outlet hole, and an outlet pipe forming a flow path along which the air passed though the outlet hole is exited.

The oven may further include a cooling fan installed at an outer side of the plurality of cooking compartments as to lead a cooling of the door by taking in outside air, wherein the outlet pipe may be provided to communicate with the cooling fan.

The oven may further include a second valve provided to open/close the outlet pipe as to prevent a backward flow of air to the plurality of cooking compartments from the cooling fan.

According to an aspect of the present invention, there is provided an oven including a casing, a plurality of cooking compartments, a circulation fan, an inlet unit, an outlet unit, a first valve and a second valve. The casing may be configured to form an external appearance of the oven. The plurality of cooking compartments may be positioned at an inside the casing. The circulation fan may be coupled to a rear surface of each of the plurality of cooking compartments as to circulate air at an inside the plurality of cooking compartments. The inlet unit may be configured to introduce outside air to an inside the plurality of cooking compartments. The outlet unit may be configured such that air at an inside the plurality of cooking compartments is exited to an outside. The first valve may be provided to open/close a flow path of the air introduced to the plurality of cooking compartments from the inlet unit. The second valve may be configured to open/close a flow path of the air discharged to the outlet unit from the plurality of cooking compartments.

The inlet unit may include an inlet hole, and an inlet motor configured to communicate with the inlet hole as to introduced outside air by intaking the outside air though the inlet hole.

A guide bracket to guide the air taken in by the inlet motor to at least one of the plurality of cooking compartments may be coupled to one side of the inlet motor. The first valve may be structured to open/close a flow path at an inside the guide bracket.

The outlet unit may include an outlet hole, and an outlet pipe forming a flow path along which the air passed though the outlet hole is exited.

Advantageous Effects

According to the above-described aspects of the present invention, different types of cooking may be simultaneously conducted at different temperatures by utilizing the spaces of a first cooking compartment and a second cooking compartment.

DESCRIPTION OF DRAWINGS

FIG. 1 is a drawing illustrating an open status of a door of an oven according to one embodiment of the present invention.

FIG. 2 is a side cross-sectional view of the oven according to one embodiment of the present invention.

FIG. 3 is a drawing of a partially-removed casing of the oven according to one embodiment of the present invention.

FIG. 4 is a drawing illustrating a disassembled status of an inlet motor and a first valve of the oven according to one embodiment of the present invention.

FIG. 5 is a drawing illustrating an open status of the first valve of the oven according to one embodiment of the present invention.

FIG. 6 is a drawing illustrating a closed status of the first valve of the oven according to one embodiment of the present invention.

FIG. 7 is a drawing of a partially-removed casing of an oven according to another embodiment of the present invention.

FIG. 8 is a drawing of a partially-removed casing of an oven according to still another embodiment of the present invention.

FIG. 9 is a drawing of a partially-removed casing of an oven according to still another embodiment of the present invention.

FIG. 10 is a flow chart illustrating a control method of the oven according to one embodiment of the present invention.

FIG. 11 is a drawing illustrating an oven according to still another embodiment of the present invention.

MODE FOR INVENTION

The invention is described more fully hereinafter with reference to the accompanying drawings, in which exemplary embodiments of the invention are shown.

FIG. 1 is a drawing illustrating an open status of a door of an oven according to one embodiment of the present invention, and FIG. 2 is a side cross-sectional view of the oven according to one embodiment of the present invention.

As illustrated on FIG. 1 and FIG. 2, an oven 1 includes a casing 10 forming an external appearance, and a cooking compartment 11 positioned at an inside the casing 10. The cooking compartment 11 is formed in the shape of a box, and a front surface thereof is provided to be open as to deposit/withdraw cooking material. The open front surface may be open/closed by a door 12 rotatably hinge-coupled in vertical direction with respect to the cooking compartment 11. A handle may be provided at the door 12. Also, at least a portion of the door 12 may be provided with transparent material such as glass to check a cooking process of the food material at an inside the cooking compartment 11 from an outside.

An electronic compartment 60 at which various electronic components (not shown), such as a circuit board, are disposed is provided at an upper portion of the cooking compartment 11. A front surface panel 15 forming the electronic compartment 60 may be provided with a display 13 to display variety of operating information of the oven 1 and a manipulation unit 14 to manipulate motions of the oven 1.

Also, an inside the cooking compartment 11 may be provided with a plurality of supporters 21 at which a rack 22 on which cooking material may be placed is mounted. The plurality of supporters 21 may be protrudedly provided from a left side wall and a right side wall of the cooking compartment 11.

The plurality of supporters 21 may be provided with a divider 23 detachably mounted thereto as the divider 23 is configured to divide the cooking compartment 11. The divider 11 is horizontally mounted at the cooking compartment 11, and may divide the cooking compartment 11 into a first cooking compartment 11*a* positioned at an upper portion and a second cooking compartment 11*b* positioned at a lower portion.

The first cooking compartment 11*a* and the second cooking compartment 11*b* are not needed to be identical in size, and the sizes of the first cooking compartment 11*a* and the second cooking compartment 11*b* may be different to each other. The divider 23 is provided with insulation material, and may insulate the first cooking compartment 11*a* and the second cooking compartment 11*b*. Also, the first cooking compartment 11*a* and the second cooking compartment 11*b* are not needed to be included, and only one cooking compartment may be included.

Each rear surface of the each of the cooking compartment 11 may be provided with a circulating fan unit 30 coupled thereto, so that the air at insides the first cooking compartment 11*a* and the second cooking compartment 11*b* may be circulated. That is, a first circulating fan unit 30*a* is coupled to a rear portion of the first cooking compartment 11*a*, and a second circulating fan unit 30*b* is coupled to a rear portion of the second cooking compartment 11*b*. A first circulating fan 34*a* of the first circulating fan unit 30*a* may have the air of the first cooking compartment 11*a* convectively flow, and a second circulating fan 34*b* of the second circulating fan unit 30*b* may have the air of the second cooking compartment 11*b* convectively flow.

The each of the circulating fan units 30 is provided with a circulating motor 33 and a circulating fan 34. A front of the circulating fan 34 may be provided with a circulating fan cover 32 coupled thereto. The circulating fan cover 32 may be provided with a through-hole unit 31 formed thereto. Accordingly, the air that is passed through the circulating fan 34 may be moved to an inside the cooking compartment 11 through the through-hole unit 31.

A cooling fan unit 50 configured to cool the temperature at an inside the electronic compartment 60 is installed at an inside the electronic compartment 60. The cooling fan unit 50 intakes outside air to an inside the electronic compartment 60, and then outlets the air taken in to a front of the oven 1.

Also, the cooking compartment 11 and the cooling fan unit 50 may communicate with each other by a flow path (not shown) provided separately. During a process of cooking food material, at least a portion of the air at an inside the cooking compartment 11 is outlet to a front of the oven 1 after inletting to the cooling fan unit 50 through the flow path (not shown).

The air inlet by the cooling fan unit 50 may be outlet to an outside through a front flow path 51 provided at a lower portion of the electronic compartment 60 to communicate with an outside.

A shield frame 62 is provided in between the first cooking compartment 11*a* and the electronic compartment 60 to shield an exposure of an inside the in-between of the first cooking compartment 11*a* and the electronic compartment 60. A first insulation material 71 may be positioned at a space in between an upper portion of the first cooking compartment 11*a*, a lower portion of the electronic compartment 60, and the shield frame 62. The first insulation material 71 is provided to prevent a delivery of the heat of an inside the first cooking compartment 11*a* to an inside the electronic compartment 60.

Also, a second insulation material 72 may be positioned in between a rear portion of the circulating fan unit 30 and the casing 10. The second insulation material 72 is provided to prevent a delivery of the heat of an inside the first cooking compartment 11*a* and the second cooking compartment 11*b* to an inside the casing 10.

When the oven 1 is operated, the air at an inside the cooking compartment 11 is heated by a heater 24, and the heated air is circulated at an inside the cooking compartment 11 and the food material is cooked. In the process as such, the temperature at an inside the cooking compartment 11 is increased, and the heat of the cooking compartment 11 is delivered to the door 12 positioned at a front surface. As to prevent such, the cooling fan unit 50 is operated as to intake outside air to cool the door 12. The cooling fan unit 50 may be installed as to inlet outside air and then outlet the outside air to an outside again.

The air taken in by the cooling fan unit 50 may flow toward a front surface of the oven 1 through the front flow path 51. The air inlet to the front surface of the oven 1 through the front flow path 51 may be outlet through a front outlet hole 51*a* adjacently provided at the door 12. An upper portion of the door 12 through which air is outlet is provided with less pressure, and the surrounding air is gathered at the upper portion of the door 12. Accordingly, the air inlet from a lower end of the door 12 through at least one of door flow path 12*a*, 12*b*, and 12*c* formed at an inside the door 12 may be moved to the upper portion of the door 12 to be outlet through the front outlet hole 51*a*.

Also, outside air may be inlet through a lower portion of a front by an operation of the cooling fan unit 50 of the oven 1, and the air as such is moved at an inside the casing 10 to cool the oven 1 and then is outlet through the front outlet hole 51*a*.

A rear surface casing 10*a* positioned at a rear surface of the casing 10 may be provided with an inlet unit configured to inlet outside air to the at least one of the cooking compartments 11. The inlet unit may include an inlet hole 41 and an inlet motor 42. The inlet hole 41 may be provided at the rear surface casing 10*a*. According to one embodiment of the present invention, the inlet hole 41 is provided to be adjacent to the second cooking compartment 11*b* as to inlet outside air to the second cooking compartment 11*b*.

An inletting of air to the inlet hole 41 may be taken place by an operation of the inlet motor 42. The air inlet to the inlet hole 41 may be inlet to an inside the second cooking compartment 11*b* through a guide bracket 45 coupled to the inlet motor 42.

Also, an outlet unit may be provided at the rear surface casing 11*a* so that the air corresponding to the amount of the air inlet to the cooking compartment 11 may be outlet from the cooking compartment 11. According to one embodiment of the present invention, the outlet unit may include an outlet hole (not shown), and an outlet pipe 52 provided in the shape of a pipe. The outlet pipe 52, which is a flow path through which air may be outlet, may be separately coupled to the rear surface casing 10*a*. The outlet pipe 52 may be coupled to the outlet hole (not shown) positioned at least at one portion of the casing 10. According to one embodiment of the present invention, the outlet hole (not shown) is positioned at least at one portion of the rear surface casing 10*a*, and the air outlet through the outlet hole (not shown) is moved through the outlet pipe 52. The air moved through the outlet pipe 52 may be outlet through the front outlet hole 51*a*.

FIG. 3 is a drawing of a partially-removed casing of the oven according to one embodiment of the present invention, and FIG. 4 is a drawing illustrating a disassembled status of the inlet motor and a first valve of the oven according to one embodiment of the present invention.

As illustrated on FIG. 3 and FIG. 4, the inlet motor 42 may be coupled to be adjacent to the circulating fan unit 30. According to one embodiment of the present invention, the inlet motor 42 may be coupled to be adjacent to the second circulating fan unit 30*b* coupled to the second cooking compartment 11*b*, as one end of the guide bracket 45 is coupled to an inlet fan housing 43. That is, the outside air inlet through the inlet hole 41 may be inlet to an inside the cooking compartment 11 after passing through the guide bracket 45 and then passing through the circulating fan cover 32 of the circulating fan unit 30.

A rear surface panel 35 may be provided at a rear surface of an inner side of the casing 10. The circulating fan unit 30 and an inlet fan 44 may be coupled to the rear surface panel 35.

The inlet motor 42 may be coupled to the inlet fan 44. Also, the inlet fan housing 43 may be coupled to the inlet fan 44. Also, one side of the inlet fan housing 43 may be provided to communicate with the guide bracket 45. The guide bracket 45 may be coupled to a communication hole 48 provided to communicate with the circulating fan unit 30. Accordingly, the outside air inlet to the inlet fan 44 by an operation of the inlet motor 42 is inlet to the second cooking compartment 11*b* through the guide bracket 45 to decrease the temperature of the second cooking compartment 11*b*. That is, the flow path through which air is inlet is formed at an inside the guide bracket 45.

The oven 1 in accordance with one embodiment of the present invention may further include a first valve 46 to open/close a flow path through which air is inlet by opening/closing at least a portion of the guide bracket 45. The first valve 46 may be coupled to the guide bracket 45 to open/close at least a portion of the guide bracket 45, and the descriptions of the above will be provided later.

Also, the outlet pipe 52 may be coupled to the rear surface panel 35 so that the air corresponding to the amount of the air inlet to the second cooking compartment 11*b* through the inlet hole 41 may be outlet. The outlet pipe 52 may be provided to communicate with the cooling fan unit 50. Accordingly, the air at an inside the cooking compartment 11 is moved to the cooling fan unit 50 through the outlet pipe 52 by an operation of the cooling fan unit 50, and may be outlet to an outside by moving from the cooling fan unit 50 to the front flow path 51*b* (FIG. 2).

The outlet pipe 52 may be coupled to the outlet hole (not shown) provided at least at one portion of the rear surface panel 35. The air at an inside the cooking compartment 11 maybe inlet to the outlet pipe 52 through the outlet hole (not shown).

More in detail, the outlet pipe 52, while having the circulating fan unit 30 as a reference, may be positioned as to be positioned at an opposite side of the inlet motor 42. That is, according to one embodiment of the present invention, when viewed from a rear surface, the inlet motor 42 is positioned at the left side of the circulating fan unit 30, and therefore, the outlet pipe 52 is positioned at the right side of the circulating fan unit 30, but is not limited hereto, and the outlet pipe 52 may be positioned in an opposite manner. The above is provided so that the outside air inlet to the inlet motor 42 may be outlet after decreasing the temperature of an inside the cooking compartment 11.

A second valve 49 provided as to open/close an outlet flow path formed at an inner side of the outlet pipe 52 may be positioned at an inner side of the outlet pipe 52, so that air may be prevented from flowing backward from the cooking fan unit 50 to the cooking compartment 11. Therefore, when air is outlet from the cooking compartment 11, the second valve 29 is in an open status, and in other cases other than the above, the second valve 49 is maintained in a closed status.

According to one embodiment of the present invention, the inlet hole 41 is provided to be adjacent to the second cooking compartment 11*b*. Accordingly, the inlet motor 42 as well is provided to be adjacent to the second cooking compartment 11*b*. More in detail, the inlet hole 41 may be provided at a position that is identical to a half position of the height of the entire casing 10, or may be provided at a lower position with respect to the height of the entire casing 10. In the case as the above, outside air may be inlet to the second cooking compartment 11*b*, and the second cooking compartment 11*b* may conduct a cooking of the food material that is provided to be cooked at a lower temperature than the temperature of the first cooking compartment 11*a*.

FIG. 5 is a drawing illustrating an open status of the first valve of the oven according to one embodiment of the present invention, and FIG. 6 is a drawing illustrating a closed status of the first valve of the oven according to one embodiment of the present invention.

As illustrated on FIG. 5 and FIG. 6, the first valve 46 may open/close a flow path at an inside the guide bracket 45.

According to one embodiment of the present invention, the first valve 46 may be provided in the form of a solenoid valve. Accordingly, in a case when electricity is provided, the first valve 46 is open, and when electricity is not provided, the first valve 46 is closed.

According to one embodiment of the present invention, the first valve 46 includes an opening/closing unit 47 to open/close the flow path, and a flange 46*a* to move the opening/closing unit 47. Accordingly, when the flow path is open, the opening/closing unit 47 is positioned at a wall surface of the guide bracket 45 so that air may inlet to the communication hole 48. In the contrary to the above, when the flow path is closed, the flange 46*a* is moved as to apply a pressure at the opening/closing unit 47 so that the opening/closing unit 47 may block the flow path, and thereby the movement of the air is blocked.

Accordingly, in a case when the temperature of an inside the second cooking compartment 11*b* is higher than a predetermined temperature that is set by a user, the first valve 46 is provided to be open, so that outside air may be inlet to an inside the second cooking compartment 11*b*, and the temperature of the second cooking compartment 11*b* may be decreased. Accordingly, the outside air may be inlet to an inside the second cooking compartment 11*b* through the communication hole 48 coupled to the guide bracket 45.

However, in other cases other than the above, as to prevent heat damage on the furniture around the oven 1 as the air inside the second cooking compartment 11*b* is released to an outside through the outlet hole 41, the first valve 46 may be maintained in a closed status. Accordingly, as the flow path is closed by the first valve 46, outside air may not be inlet to an inside the second cooking compartment 11*b* through the communication hole 48.

A control unit may adjust an inlet of outside air as to decrease the temperature of the second cooking compartment 11*b*, while considering a proper temperature of the second cooking compartment 11*b* by using an operation of the first valve 46, according to a selection or a setting on a cooking mode by a user, and in the case as such, the control unit may have the temperature of the second cooking compartment 11*b* provided with a difference with respect to the temperature of the first cooking compartment 11*a*. Conventionally, in a case when the temperature of the first cooking compartment 11*a* is set at about 250° C., the temperature of the second cooking compartment 11*b* is increased above about 170° C. even when no additional heat is applied at the second cooking compartment 11*b*. However, according to one embodiment of the present invention, under the identical condition, the temperature of the first cooking compartment 11*a* may set at about 250° C. and the temperature of the second cooking compartment 11*b* may be set below about 100° C. Accordingly, the range of cooking temperature at which a cooking may be conducted in the oven 1 may be increased.

Also, when a user inputs a cooking mode of the oven 1, the first cooking compartment 11*a* and the second cooking compartment 11*b* are operated, and as to inlet outside air with respect to the second cooking compartment 11*b*, which is a cooking compartment that is needed to be maintained at a low temperature after a certain period of time is passed, the first valve 46 is open, and the second valve 49 is open when the first valve 46 is open. Also, when the first valve 46 is closed, the second valve 49 is together closed.

Also, according to one embodiment of the present invention, the first valve 46 and the second valve 49 may be open while a cooking is in progress or after a cooking is finished, and in the case as the above, a cooking with respect to food material may be conducted in various methods. Accordingly, a user at the time of needs may remove the moisture at an inside the cooking compartment 11 after inletting outside air to an inside the cooking compartment 11 by opening the first valve 46 and the second valve 49 by manipulating the manipulation unit 14 of the front surface panel 15. Also, in a case when a cooking is conducted with respect to one of the first cooking compartment 11*a* and the second cooking compartment 11*b*, by inletting outside air with respect to only one of the first cooking compartment 11*a* and the second cooking compartment 11*b*, a ventilation may be provided to an inside the cooking compartment.

FIG. 7 is a drawing of a partially-removed casing of an oven according to another embodiment of the present invention.

As illustrated on FIG. 7, inlet motors 142*a* and 142*b* may be coupled to rear surfaces of the first cooking compartment 11*a* and the second cooking compartment 11*b*. In the case as such, inlet holes (not shown) may be provided at a rear surface casing 10*a* to respectively communicate with the first cooking compartment 11*a* and the second cooking compartment 11*b*. The each of the inlet motors 142*a* and 142*b* may be provided with inlet fan covers 143*a* and 143*b* coupled thereto, respectively.

Accordingly, guide brackets 145*a* and 145*b*, which are flow paths through which air is inlet, also are coupled to rear portions of the first cooking compartment 11*a* and the second cooking compartment 11*b*, respectively, and the guide brackets 145*a* and 145*b* are provided with first valves 146*a* and 146*b* coupled thereto, respectively.

Since air may be inlet to the first cooking compartment 11*a* and the second cooking compartment 11*b*, the outlet of the air as well is needed to be taken place at the first cooking compartment 11*a* and the second cooking compartment 11*b*. Therefore, an outlet pipe 150 is coupled to the first cooking compartment 11*a* and the second cooking compartment 11*b*, and an outlet hole (not shown) as well may be provided at a rear surface of the each of the first cooking compartment 11*a* and the second cooking compartment 11*b*.

According to one embodiment of the present invention, the outlet pipe 150 is provided to be divided to the outlet holes (not shown) of the first cooking compartment 11*a* and the second cooking compartment 11*b* from one main outlet pipe 151, and is not limited hereto, and each outlet pipe may be separately provided. According to one embodiment of the present invention, the outlet pipe 150 may include the main outlet pipe 151, and a first branch outlet pipe 152*a* and a second branch outlet pipe 152*b* coupled to the outlet holes (not shown) after branched from the main outlet pipe 151. The air moved to the first branch outlet pipe 152*a* and the second branch outlet pipe 152*b* though the outlet holes (not shown) is outlet to an outside the oven 1 after passing through the main outlet pipe 151 and the cooling fan unit 50.

According to one embodiment of the present invention illustrated on FIG. 7, outside air may be inlet with respect to the each of the first cooking compartment 11*a* and the second cooking compartment 11*b* according to a cooking mode, and a cooking provided with increased range of temperature may be conducted.

FIG. 8 is a drawing of a partially-removed casing of an oven according to still another embodiment of the present invention.

As illustrated on FIG. 8, an inlet motor 242 may be coupled to a rear surface of the second cooking compartment 11*b*. The inlet motor 242 may be provided with an inlet fan cover 243 coupled thereto. Guide brackets 245 and 248, which are flow paths through which air is inlet, may include a first guide bracket 248 and a second guide bracket 245. The first guide bracket 248 may be coupled to a rear surface of the first cooking compartment 11*a*, and the second guide bracket 145 may be coupled to a rear surface of the second cooking compartment 11*b*.

The second guide bracket 245 may be extended from the first guide bracket 248 and may be divided to be branched toward the first cooking compartment 11*a*. Therefore, according to one embodiment of the present invention, air may be inlet to the first cooking compartment 11*a* and the second cooking compartment 11*b* using the one inlet motor 242.

The first guide bracket 248 and the second guide bracket 245 may be provided with first valves 246*a* and 246*b* configured to open/close flow paths at insides the first guide bracket 248 and the second guide bracket 245 coupled thereto, respectively. Outside air may be inlet with respect to only one of the first cooking compartment 11*a* and the second cooking compartment 11*b* by adjusting openings/closings of the first valves 246*a* and 246*b*.

Also, an outlet pipe 250 is provided to include a first branch outlet pipe 252*a* and a second branch outlet pipe 252*b* to be branched to outlet holes (not shown) of the first cooking compartment 11*a* and the second cooking compartment 11*b* from one main outlet pipe 251, but is not limited hereto, and each outlet pipe may be separately provided.

FIG. 9 is a drawing of a partially-removed casing of an oven according to still another embodiment of the present invention.

As illustrated on FIG. 9, outlet pipes 351*a* and 315*b* may be coupled to different one surface instead of the rear surface of the cooking compartment 11. According to one embodiment of the present invention, the outlet pipes 351*a* and 315*b* may be coupled to a side of the cooking compartment 11. That is, the outlet pipes 351*a* and 315*b* are not needed to be adjacently coupled to an inlet motor 342, and may be coupled to at least one surface of the cooking compartment 11 through which outside air is inlet.

The inlet motor 342, as described above, may be provided with an inlet fan cover 343 may be coupled thereto, and the inlet fan cover 343 may be provided with a guide bracket 345 coupled thereto. Also, a first valve 346*b* capable of opening/closing a flow path at an inside the guide bracket 345 may be coupled.

According to one embodiment of the present invention, the first outlet pipe 351*a* and the second outlet pipe 351*b* may be coupled to both sides of the cooling fan 50. The first outlet pipe 351*a* and the second outlet pipe 351*b* may be coupled to both side surfaces of the second cooking compartment 11*b* through which outside air is inlet, and accordingly, the air at an inside the second cooking compartment 11*b* may be efficiently outlet. Also, a second valve (not shown) capable of opening/closing a flow path of inside air may be positioned at an inner side of the each of the first outlet pipe 351*a* and the second outlet pipe 351*b*. Accordingly, the flow path of the inner side of the each of the first outlet pipe 351*a* and the second outlet pipe 351*b* may be selectively open/closed.

FIG. 10 is a flow chart illustrating a control method of the oven according to one embodiment of the present invention.

As illustrated on FIG. 10, the first cooking compartment and the second compartment are operated (S200) after a user inputs (S100) a cooking mode. The user may input a cooking mode by manipulating the manipulation unit of the front surface panel (S100). The maximum operating temperature T1 of the first cooking compartment and the maximum operating temperature T2 of the second cooking compartment are determined when the user inputs the cooking mode (S100).

The first cooking compartment and the second cooking compartment are operated according to the determined cooking mode (S200). The first cooking compartment and the second cooking compartment are operated as the temperatures thereof are increased up to the maximum operating temperatures T1 and T2, respectively. According to one embodiment of the present invention illustrated from FIG. 1 to FIG. 6, the maximum operating temperature T2 of the second cooking compartment is formed to be lower than the maximum operating temperature T1 of the first cooking compartment. According to one embodiment of another embodiment of the present invention, as outside are may be inlet to the first cooking compartment and the second cooking compartment, the maximum operating temperature T1 of the first cooking compartment may be formed to be lower than the maximum operating temperature T2 of the second cooking compartment. Hereinafter, a case of one embodiment of the present invention illustrated from FIG. 1 to FIG. 6 will be used as an example for description. Conventionally, the measured temperatures t2A and t2B of the second cooking compartment is exceeded the maximum operating temperature T2 of the second cooking compartment due to the maximum operating temperature T1 of the first cooking compartment, and accordingly, the cooking of the second cooking compartment is not smoothly proceeded.

According to one embodiment of the present invention, the control unit measures the temperature t2A of the second cooking compartment (S300) after operating the first cooking compartment and the second compartment (S200). Accordingly, the relationship between the present temperature t2A of the second cooking compartment and the maximum operating temperature T2 of the second cooking compartment is determined (S301). In a case when the temperature t2A of the second cooking compartment is higher than the maximum operating temperature T2 of the second cooking compartment, the first valve and the second valve are open (S401) so that the temperature t2A of the second cooking compartment may be decreased. In a case when the temperature t2A of the second cooking compartment is lower than the maximum operating temperature T2 of the second cooking compartment, the coking is proceeded (S500).

The first valve and the second valve are open (S401), and the control unit measures the temperature t2B of the second cooking compartment again (S302). In a case when the temperature t2B of the second cooking compartment is higher than the maximum operating temperature T2 of the second cooking compartment, the open status of the first valve and the second valve are maintained (S401). In a case when the temperature t2B of the second cooking compartment is lower than the maximum operating temperature T2 of the second cooking compartment, the first valve and the second valve are closed (S402).

After the above, the cooking is proceeded (S500). The cooking is proceeded (S500), and prior to the finishing of the cooking (S600), the control unit additionally may measure the temperature t2C of the second cooking compartment again (S304), so that the temperature at an inside the second cooking compartment may be checked until the finishing of the cooking (S600). In a case when the temperature t2C of the second cooking compartment is higher than the maximum operating temperature T2 of the second cooking compartment, the first valve and the second valve are open (S401). In a case when the temperature t2C of the second cooking compartment is lower than the maximum operating temperature T2 of the second cooking compartment, the cooking is finished by proceeding with the cooking (S600).

According to the control method of the oven in accordance with one embodiment of the present invention, by determining whether the temperatures t2A, t2B, and t2C of the second cooking compartment are higher than the maximum operating temperature T2 of the second cooking compartment that is set according to the cooking mode, a determination may be made whether to open/close the first valve and the second valve that communicate with the second cooking compartment, and the cooking having different temperature range of cooking with respect to the first cooking compartment and the second cooking compartment may be proceeded.

FIG. 11 is a drawing illustrating an oven according to still another embodiment of the present invention. As illustrated on FIG. 11, an oven 1*a* may include a first cooking compartment 17, a second cooking compartment 18, and a third cooking compartment 19. A first divider 25 and a second divider 27 may be detachably mounted at an inside a casing 10*c*. The first cooking compartment 17 and the second cooking compartment 18 may be divided by the first divider 25, and the second cooking compartment 18 and the third cooking compartment 19 may be divided by the second divider 27.

The oven 1*a* includes at least one of heating units 37, 28 and 39. On FIG. 11, an example of a heating unit disposed as to correspond to the each cooking compartment, but a heating unit may be installed at some of the cooking compartments. Also, on FIG. 11, an example of the heating units 37, 38, and 39 each disposed at an outside the each cooking compartment, but a heating unit may be disposed at an inside each cooking compartment. The heating units 37, 38, and 39 may include a heater to generate heat by receiving electric energy. Also, the heating units 37, 38, and 39 may include a fan motor unit to draft the air heated by the heater to an inside the cooking compartments.

The oven 1*a* is provided with an inlet unit to supply outside air to the third cooking compartment 19. As outside air is supplied to the third cooking compartment 19 through the inlet unit while cooking, the temperature of the third cooking compartment may be adjusted. The inlet unit may be disposed at a rear portion of the third cooking compartment 19.

The inlet unit may include an inlet hole 410 and a draft apparatus 420. The draft apparatus 420 may include an inlet motor 422, and an inlet fan 424 configured to be rotated by the inlet motor. The inlet unit is provided with a communication hole 430 positioned to communicate with the third cooking compartment 19. The air inlet from an outside by the draft apparatus 420 is supplied to an inside the third cooking compartment 19 through the communication hole 430.

As illustrated on FIG. 11, the air drafted by the inlet unit may be supplied to the third cooking compartment 19 after passing through a space 39*s* at which the heating unit 39 is installed. However, the current by the inlet unit may be provided to be directly supplied to the third cooking compartment 19.

An outlet pipe 440 may be connected to the third cooking compartment 19. The air at an inside the third cooking compartment 19 may be outlet to an outside through the outlet pipe 440.

On FIG. 11, an example of the inlet unit installed at the third cooking compartment 19, but the inlet unit may be installed at the first cooking compartment 17 or the second cooking compartment 18. Also, the inlet unit may be installed at the two cooking compartments of the three cooking compartments, or may be installed at the all of the three cooking compartments. Also, with respect to an oven having a cooking compartment divided into more than four units thereof, the inlet unit may be installed at certain one unit of the cooking compartments divided as the above as to supply outside air.

The invention claimed is:

1. An oven, comprising:

a casing to form an external appearance of the oven;

a cooking compartment positioned at an inside the casing, and including a first cooking compartment positioned at an upper side and a second cooking compartment positioned at a lower side;

a door to open/close the cooking compartment;

a divider positioned in between the first cooking compartment and the second cooking compartment;

a first circulating fan and a second circulating fan coupled to rear surfaces of the first cooking compartment and the second cooking compartment, respectively;

an inlet unit to introduce outside air to at least one of the first cooking compartment and the second cooking compartment;

an outlet pipe to communicate the cooking compartment with an outside so as to discharge a predetermined amount of air inside the cooking compartment; and a cooling fan configured to discharge the air inside the cooking compartment to the outside through the outlet pipe.

2. The oven of claim 1, wherein:

the inlet unit comprises an inlet hole, and an inlet motor configured to introduce outside air while coupled to the inlet hole.

3. The oven of claim 2, wherein:

a guide bracket to guide the air that is taken in by the inlet motor to at least one of the first cooking compartment and the second cooking compartment is positioned at one side of the inlet motor.

4. The oven of claim 3, further comprising:

a first valve to open/close a flow path at an inside the guide bracket as to prevent the air at an inside the cooking compartment from released to an outside.

5. The oven of claim 3, wherein:

the guide bracket is coupled to a communication hole provided to communicate with at least one of the first cooking compartment and the second cooking compartment.

6. The oven of claim 1, wherein the cooling fan is installed at an outer side of the cooking compartment as to lead a cooling of the door by intaking outside air.

7. The oven of claim 6, wherein:

the outlet pipe is provided to communicate with the cooling fan.

8. The oven of claim 7, wherein:

the outlet pipe is coupled to an outlet hole provided at one surface of the cooking compartment.

9. The oven of claim 8, further comprising:

a second valve provided to open/close the outlet hole as to prevent a backward flow of air to the cooking compartment from the cooling fan.

10. The oven of claim 2, wherein:

the inlet hole is provided at a position that is equal to or lower than a position of a half the height of the casing.

11. The oven of claim 2, wherein:

the inlet motor is provided in a plurality of units thereof, and each of the plurality of inlet motors is coupled to a rear surface of each cooking compartment.

12. The oven of claim 1, wherein:

the outlet pipe comprises a main outlet pipe, and a first branch outlet pipe and a second branch outlet pipe that are branched from the main outlet pipe and coupled to the first cooking compartment and the second cooking compartment, respectively.

13. An oven, comprising:

a casing to form an external appearance of the oven;

a plurality of cooking compartments positioned inside the casing, and configured to be heated to different temperatures from each other;

a heater provided in the plurality of cooking compartments;

a door to open and close the plurality of cooking compartments;

a divider provided between the plurality of cooking compartments to reduce heat transfer between the plurality of cooking compartments;

an inlet unit provided to communicate with at least one of the plurality of cooking compartments to lower a temperature inside the at least one of the plurality of cooking compartments by introducing air from outside the plurality of cooking compartments into the at least one of the plurality of cooking compartments while the door is closed;

an outlet unit configured to discharge air from inside the at least one of the plurality of cooking compartments to outside the plurality of cooking compartments while the door is closed; and a cooling fan configured to discharge the air inside the at least one of the plurality of cooking compartments to an outside through the outlet unit, wherein the outlet unit communicates the cooking compartment with the outside so as to discharge a predetermined amount of air inside the cooking compartment.

14. The oven of claim 13, wherein:

the inlet unit comprises an inlet hole, and an inlet motor configured to communicate with the inlet hole as to introduce outside air by intaking the outside air through the inlet hole.

15. The oven of claim 13, further comprising:

a communication hole to communicate with the plurality of cooking compartments such that the air that is introduced through the inlet hole and the inlet motor is moved to an inside the plurality of cooking compartments.

16. The oven of claim 15, further comprising:

a guide bracket positioned in between the communication hole and the inlet motor, wherein a first valve to open/close the communication hole to prevent the air at an inside the plurality of cooking compartments from being released to an outside is positioned at an inside the guide bracket.

17. The oven of claim 13, wherein:

the outlet unit comprises an outlet hole, and an outlet pipe forming a flow path along which the air passed though the outlet hole is exited.

18. The oven of claim 17, wherein the cooling fan is installed at an outer side of the plurality of cooking compartments as to lead a cooling of the door by taking in outside air, wherein the outlet pipe is provided to communicate with the cooling fan.

19. The oven of claim 18, further comprising:

a second valve provided to open/close the outlet pipe as to prevent a backward flow of air to the plurality of cooking compartments from the cooling fan.

20. An oven, comprising:

a casing to form an external appearance of the oven;

a plurality of cooking compartments positioned at an inside of the casing;

a circulation fan coupled to a rear surface of each of the plurality of cooking compartments so as to circulate air at an inside of the plurality of cooking compartments;

an inlet unit configured to introduce outside air to an inside of the plurality of cooking compartments;

an outlet unit configured such that air at an inside of the plurality of cooking compartments is exited to an outside;

a first valve provided to open/close a flow path of the air introduced to the plurality of cooking compartments from the inlet unit;

a second valve to open/close a flow path of the air discharged to the outlet unit from the plurality of cooking compartments; and a cooling fan configured to discharge the air inside the at least one of the plurality of cooking compartments to the outside through the outlet unit, wherein the outlet unit communicates the cooking compartment with the outside so as to discharge a predetermined amount of air inside the cooking compartment.

21. The oven of claim 20, wherein:

the inlet unit comprises an inlet hole, and an inlet motor configured to communicate with the inlet hole as to introduced outside air by intaking the outside air though the inlet hole.

22. The oven of claim 21, wherein:

a guide bracket to guide the air taken in by the inlet motor to at least one of the plurality of cooking compartments is coupled to one side of the inlet motor, and the first valve is structured to open/close a flow path at an inside the guide bracket.

23. The oven of claim 20, wherein:

the outlet unit comprises an outlet hole, and an outlet pipe forming a flow path along which the air passed though the outlet hole is exited.

* * * * *